United States Patent [19]

Grussen

[11] 4,394,918

[45] Jul. 26, 1983

[54] SCREW CAP WITH TAMPER-PROOF HOLD RING

[75] Inventor: Jean Grussen, Breval, France

[73] Assignee: Charles A. Breskin Assoc. Inc., White Plains, N.Y.

[21] Appl. No.: 279,364

[22] Filed: Jul. 1, 1981

[30] Foreign Application Priority Data

Feb. 11, 1981 [FR] France ..... 81 02723

[51] Int. Cl.[3] ..... B65D 41/34

[52] U.S. Cl. ..... 215/243; 215/252; 215/253

[58] Field of Search ..... 215/252, 253, 243

[56] References Cited

U.S. PATENT DOCUMENTS

| | | | |
|---|---|---|---|
| 2,961,119 | 11/1960 | Leach | 215/252 X |
| 4,109,814 | 8/1978 | Rausing | 215/253 X |
| 4,153,174 | 5/1979 | Keeler | 215/252 |
| 4,196,818 | 4/1980 | Brownbill | 215/252 |
| 4,299,329 | 11/1981 | Ochs et al. | 215/252 |
| 4,333,577 | 6/1982 | Mumford | 215/252 |

FOREIGN PATENT DOCUMENTS

| | | | |
|---|---|---|---|
| 1265008 | 3/1972 | United Kingdom | 215/253 |
| 2033350 | 5/1980 | United Kingdom | 215/252 |

*Primary Examiner*—Donald F. Norton

*Attorney, Agent, or Firm*—Lawrence Rosen

[57] ABSTRACT

The disclosure concerns a screw cap comprised of semi-rigid plastic material and including a tamper-proof hold ring. The screw cap is for use on the neck of a container, such as a bottle. The hold ring has an inside diameter that is at least equal to the outside diameter of the cap body. Six lock lugs supported on the ring are inclined upwardly and inwardly toward the neck closing end of the cap body. The lock-lugs elastically hook behind a collar or mating ring at the bottle neck to prevent the tamper-proof hold ring from being lifted off the neck of the bottle when the cap body is unscrewed. Breakable attachment tabs initially hold the cap body to the tamper-proof hold ring and these are broken as the cap is initially unscrewed. An unbreakable flange between the cap body and the tamper-proof ring serves as a tilt hinge for the unscrewed cap.

18 Claims, 5 Drawing Figures

SCREW CAP WITH TAMPER-PROOF HOLD RING

BACKGROUND OF THE INVENTION

1. Field of the Invention

The present invention relates to a screw cap of semi-rigid plastic material, or the like, for necks of containers such as bottles, and particularly relates to a closed, tamper-proof hold ring developed integral with the body of the cap and connected by several breakable attachment tabs to the lower edge of the body of the cap. The hold ring is intended to catch below a mating ring or collar located generally at the neck of the container.

2. Description of the Prior Art

Many known tamper-proof systems for screw caps of plastic material, or the like, generally comprise a tamper-proof hold ring of the "catch" type. Upon placing the cap on the neck of the container, the hold ring "jumps over" the thread of the neck and places itself behind the mating ring or collar at the neck. These catch-type tamper-proof hold rings are located substantially in the downward extension of the lower edge of the cap body. Their main drawback is that the manufacture of a cap having such a hold ring requires a complicated so-called "drawer" mold to permit removal of the cap together with its tamper-proof ring from the mold because the tamper-proof ring forms an undercut portion with respect to the side wall of the cap.

Another known tamper-proof hold ring cooperates with a mating ring or collar at the neck of the container, not by catching on the mating ring or collar, but by shrinkage of the tamper-proof hold ring by heating it and possibly by clamping it with pliers. This has the drawback that placing the tamper-proof hold ring on the neck requires a heating system, and possibly a clamping system, which considerably complicates placement of the cap, and it also requires modification of conventional capping machines.

Other caps having tamper-proof hold rings are simpler to remove from a mold. But, these tamper-proof hold rings do not cooperate with a mating ring or collar of a standard container neck. Instead, these hold rings copperate with special means which are provided on the container neck.

SUMMARY OF THE INVENTION

The object of the present invention is to provide a screw type container cap of plastic, or the like, with a tamper-proof hold ring, which cap can be manufactured at high speed in a simple mold and which permits simple attachment on a standard container neck, without any change in the capping machines.

Another object of the invention is to provide such a screw cap which prevents the cap from popping off when it is unscrewed from a container containing carbonated beverages.

Still another object of the invention is to provide such a screw cap which gives a visible indication of any opening or attempted opening of the container cap.

A further object of the invention is to provide such a screw cap which may remain attached to the container at all times and which can, when the container is empty, be removed in a simple manner.

The screw cap in accordance with the invention is comprised of a semi-rigid material, such as a plastic. It is intended for use on the necks of containers such as bottles. The screw cap includes a closed, annular, tamper-proof hold ring which is integrally formed with the body of the cap and is connected to the lower edge of the body of the cap by several breakable attachment tabs. The tamper-proof hold ring is intended to hook below a mating ring that is defined generally at, e.g. just below the neck of the container, or most preferably below a collar defined at the neck of the container. The tamper-proof hold ring has an inside diameter that is at least equal to the outside diameter of the body of the cap.

The hold ring has a plurality of at least three and preferably six cap lock-lugs distributed around its periphery and these protrude toward the inside of and the closed bottom end of the cap body so that a circle passing through the free ends of the lock-lugs has a diameter that is less than the outside diameter of the neck below the collar or mating ring at the neck.

Neither the tamper-proof hold ring itself nor the lock-lugs formed on this ring interfere with the removal of the cap from the mold in which the cap is molded. The ring does not interfere because of its above noted diameter. The lock-lugs do not interfere because they are usually initially molded to project toward the bottom of the hold ring and are bent up to their desired orientation after the cap is removed from the mold.

Upon placement of the cap on a container neck with the lock-lugs at their desired upturned orientation, the lock-lugs flex elastically upward so as to pass over the screw threads on the neck and then over the collar or mating ring at the neck. Then the lock-lugs hook below that collar or mating ring. Upon unscrewing of the cap, the lock-lugs press up against and arch below the collar or mating ring at the neck, which tears the breakable attachment tabs between the tamper-proof hold ring and the cap body.

The tamper-proof hold ring is additionally connected to the cap body, between two breakable attachment tabs, by a non-breakable attachment flange. The non-breakable attachment flange keeps the tamper-proof ring at all times connected to the body of the cap, but it does not prevent unscrewing of the cap. The attachment flange prevents the cap from projecting away under the effect of the pressure present within the container. The flange is dimensioned to serve as a hinge for the cap, so that the cap may be pivoted around the hinge to lift off the container neck.

It is also possible to remove the tamper-proof hold ring from the container by simply exerting a pull on the unscrewed cap. This makes it possible to easily free the containers from the tamper-proof hold rings, which is of interest for both deposit bottles and containers and for non-deposit bottles and containers intended to be recycled. In the latter case, it is thus possible to avoid mixtures of the materials of the container and the cap, which would complicate the recycling.

On both sides of the non-breakable attachment flange by which the tamper-proof hold ring is permanently hingedly connected to the cap body, the hold ring has a notch which extends from its upper edge down over a portion of its height, and preferably over at least half of its height. Thus, upon initial unscrewing of the cap, which results in breaking of the breakable attachment tabs, the tamper-proof hold ring is permanently deformed at the location of the notches and remains deformed if the cap is rescrewed onto the neck.

In order to aid the permanent deformation of the tamper-proof hold ring upon initial unscrewing of the cap, it is advantageous for the non-breakable attachment flange to be located between two lock-lugs of the hold ring.

Other objects and features of the invention will be apparent from the following description and the accompanying drawings showing diagrammatically one non-limiting embodiment of a cap with tamper-proof ring in accordance with the invention.

BRIEF DESCRIPTION OF THE DRAWINGS

FIG. 2 shows the non-breakable attachment flange between the tamper-proof ring and the cap body before initial unscrewing of the cap, and FIG. 3 shows the same view after initial unscrewing and subsequent rescrewing of the cap onto the bottle neck.

DESCRIPTION OF A PREFERRED EMBODIMENT

Figure 1:
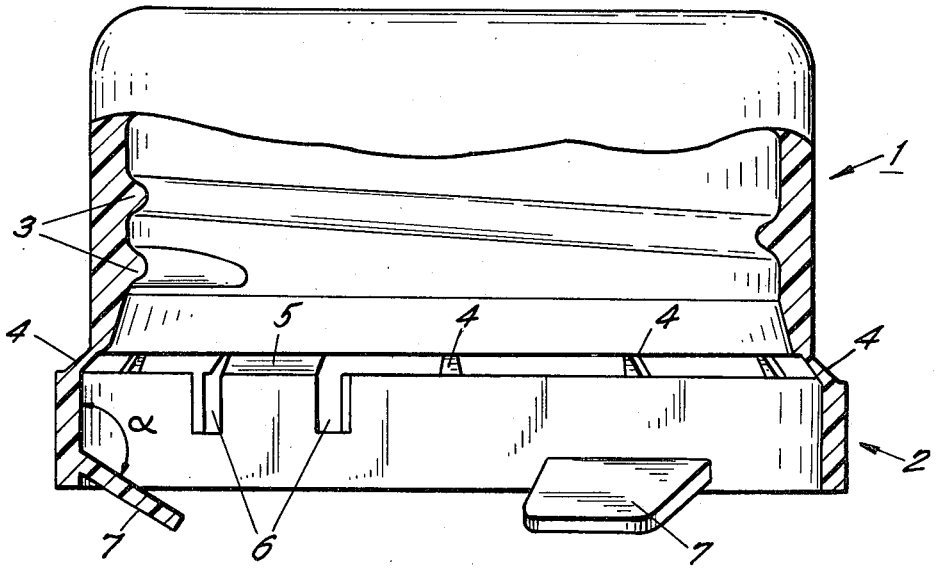
FIG. 1 is a side elevation, partially in axial section, viewed along lines 1—1 in FIG. 5, through a screw cap in accordance with the invention, following its removal from the mold.
Figure 2:
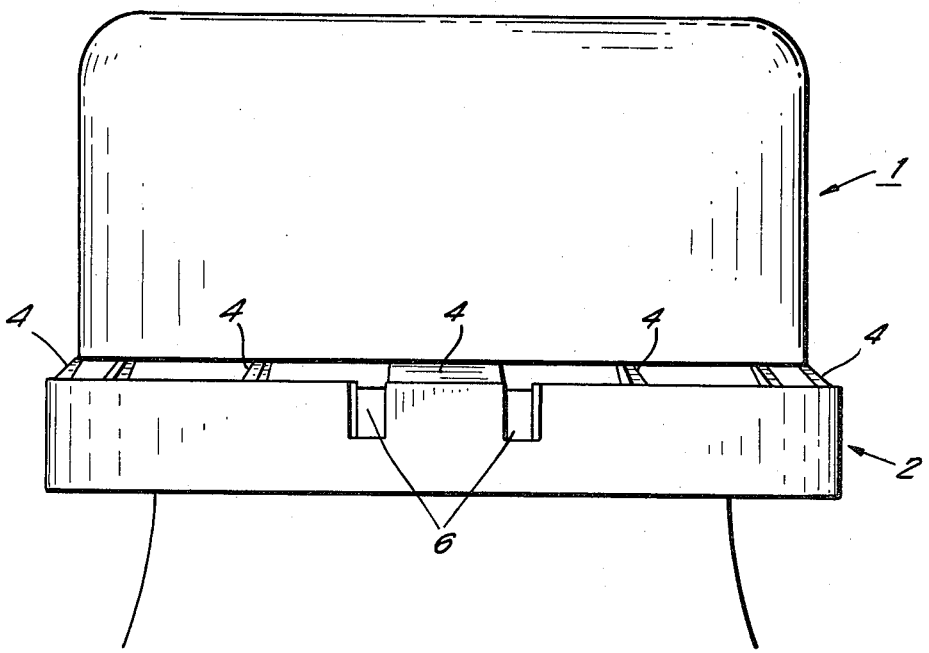
FIGS. 2 and 3 are views in elevation of the same cap on a bottle neck.

The screw cap shown in FIG. 1 comprises a cap body 1 and a tamper-proof hold ring 2, which are integrally made or molded of a single piece of semi-rigid plastic material, for instance polyethylene or polypropylene.

As is customary, the cap body 1 has the shape of an inverted cup. Inside its annular side wall, the cap body 1 has an inner helical thread 3 intended to cooperate with the outer thread 11 of a container neck 12, for instance a bottle neck. The cap body 1 may have sealing means (not shown) in the closed bottom end 9 of its cup-shaped body. This can, for instance, be an attached gasket cooperating with the open end of the neck 12 or a sealing lip or skirt cooperation with the inside of the neck at its open end. These sealing means or others are well known.

The tamper-proof hold ring 2 has the form of a closed ring with an inside diameter that is slightly greater than the outside diameter of the cap body 1 above it. The upper edge of the ring 2 is connected to the lower edge of the cap body 1 by several breakable attachment tabs 4 of small cross section, which are distributed around the periphery of the cap body 1.

Figure 4:
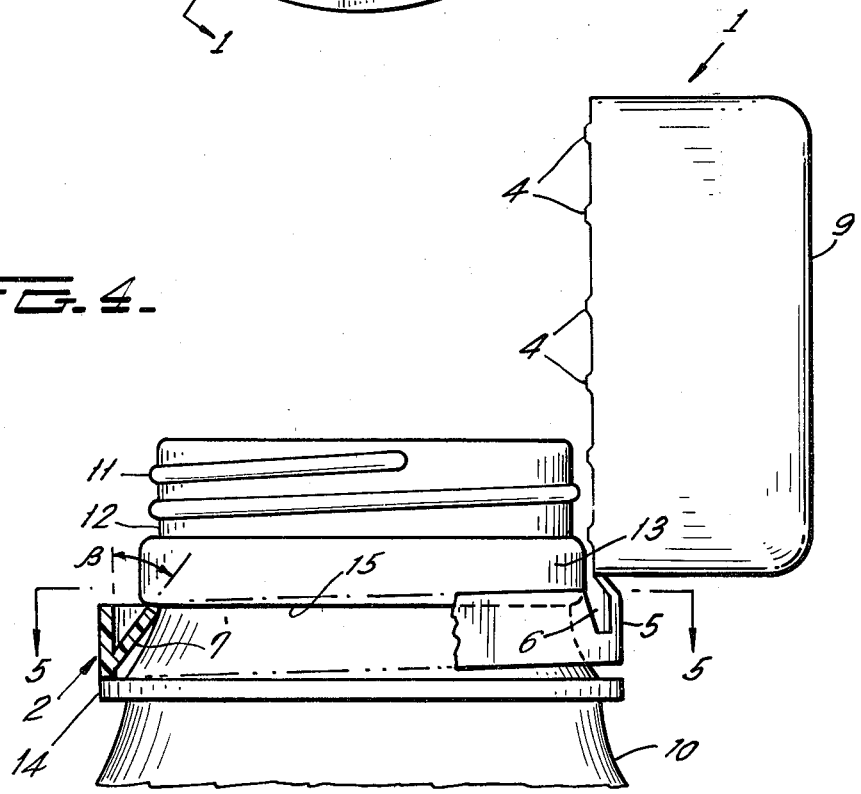
FIG. 4 is another elevational view of the cap on a bottle neck, from a different direction, viewed along lines 4—4 of FIG. 5, with the hold ring of the cap partially broken away, showing the cap unscrewed.

Additionally, the upper edge of the ring 2 is connected to the lower edge of the cap body 1 by an essentially non-breakable attachment flange 5 whose peripheral or circumferential width is greater than that of the breakable attachment tabs 4. The radial thickness of the attachment flange 5 is less than the radial thickness of the ring 2. The flange 5 serves as the hinge at which the cap body 1 is pivoted off the bottle neck 12, as shown in FIG. 4. The thickness of the flange is selected to permit this. Further, the flange width and thickness are selected so that the flange can be torn to remove the cap body completely, if desired. But, the flange 5 must be strong enough to withstand normal handling during cap opening and closing and to resist the cap popping off the container due to high pressure in the container.

At both opposite annular sides of the attachment flange 5, the hold ring 2 is weakened by a notch 6 which extends downward from the upper edge of the ring 2. In the embodiment shown, the depth of the notches 6 is more than half the height of and slightly less than the total height of the ring 2.

Figure 5:
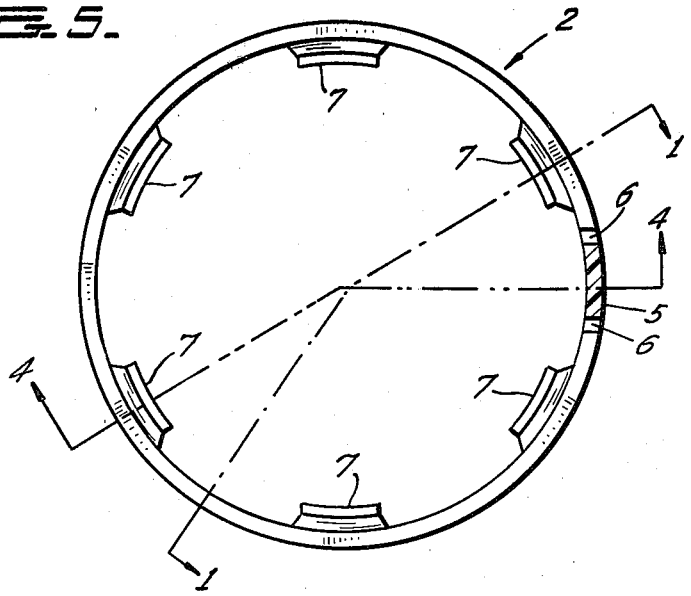
FIG. 5 is a view of the hold ring of the cap taken in the direction of arrows 5 in FIG. 4.

The tamper-proof ring 2 has several tongues that serve as lock-lugs 7 distributed around its periphery and directed to protrude toward the inside of the ring. Six uniformly spaced apart lock-lugs are illustrated in FIGS. 1 and 5. The lock-lugs 7 are flat and are formed in the vicinity of the lower edge of the ring 2. The lock-lugs are distributed around the periphery of the ring 2 in such a manner that the non-breakable attachment flange 5 between the ring 2 and the cap body 1 is located substantially midway between two adjacent lock-lugs 7.

FIG. 1 illustrates the cap 1, 2 upon its emergence from the manufacturing mold. When first molded, the lock-lugs 7 are initially inclined downward and inwardly, so as to form an obtuse angle $\alpha$, for instance of 120° to 140°, with the inner face of the upper portion of the ring 2. Before this cap is placed on a bottle neck 12, it is necessary to deform the lock-lugs 7 permanently upward, toward the closed upper end 9 of the cap body 1, so that they define an acute angle $\beta$ of for instance 40° to 60° with the inner wall of the ring 2. The lock-lugs are post formed to their upwardly inclined orientation illustrated in FIG. 4 right out of the mold before the plastic, e.g. polypropylene, sets up and crystallizes. It is also possible to mold the cap directly with the lock-lugs 7 in their final orientation, that is to say, with an acute angle $\beta$.

The lock-lugs 7 are of such length that when they occupy the upwardly bent, acute angle position, a circle passing through their free ends has a diameter that is less than the outside diameter of the neck 12 of the bottle 10 below the collar or mating ring 13 beneath which the lock lugs 7 are intended to hook.

The cap 1, 2 is intended to be placed on the neck 12 of the bottle 10. There is a collar or mating ring 13 defined on the bottle, generally at the neck, for cooperating with the lock-lugs 7.

With the lock-lugs 7 in their final, upwardly bent position, the cap is placed on the neck of the bottle to be stoppered and a push is exerted against the end of the cap, so that the lock-lugs 7 bend elastically upward while the hold ring 2 and the lock-lugs pass over the outer thread 11 of the bottle neck 12. The thread 3 in the cap body meets the bottle neck and the cap body 1 is then screwed onto the neck, while the lock-lugs 7 flex elastically upward to pass over the collar or mating ring 13 to the neck 12. Eventually, the hold ring 2 nests between the collar 13 above it and the additional ring 14 defined on the container beneath the collar. Toward the end of the screwing on of the cap body 1, the lock-lugs 7 engage elastically behind the shoulder 15 of the mating ring 13 and apply themselves against the outer wall of the neck.

During this emplacement of the cap, the breakable attachment tabs 4 experience only slight compressive and shearing forces, which these attachment tabs are quite able to resist. The tamper-proof hold ring 2 continues to occupy the same relative position with respect to the cap body 1 as before the placement of the cap on the bottle neck.

Figure 3:
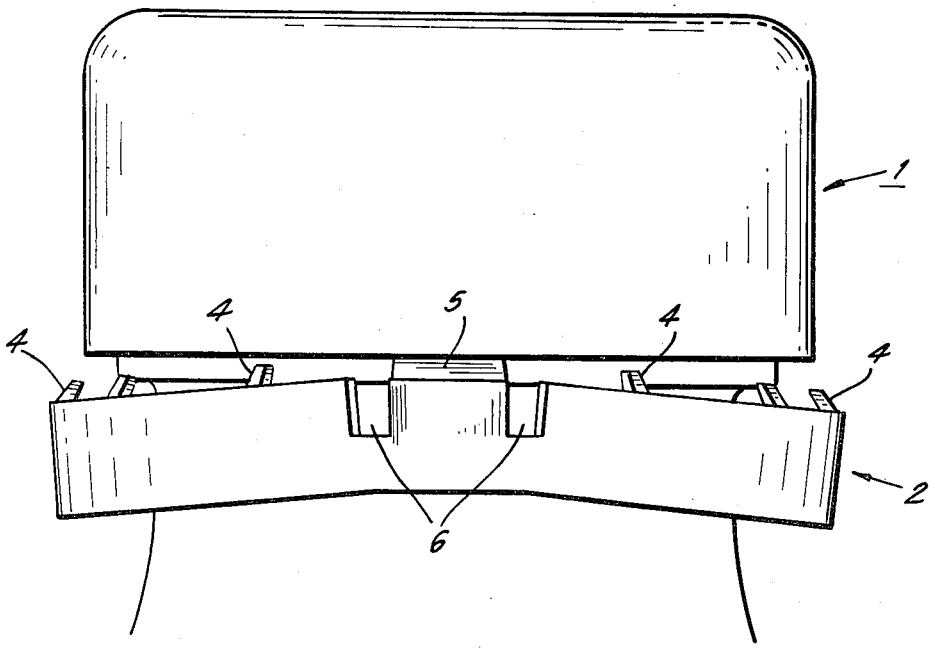

During the first time that the cap 1 is unscrewed, when the cap body 1 moves upward with respect to the neck of the bottle 10, the lock-lugs 7 arch against the shoulder 15 of the mating ring 13 of the neck and thus prevent the tamper-proof hold ring 2 from following the upward movement of the cap body 1. This causes the breaking of the breakable attachment tabs 4. However, since the ring 2 is still permanently connected to the cap body 1 by the non-breakable attachment flange 5, and the ring 2 is moreover held by the lock-lugs 7, the ring 2 undergoes flexure which causes a plastic deformation of the ring 2 at the two notches 6, as shown in FIG. 3. Selecting as short a length as possible for the lock-lugs and increasing their number, e.g. to six, makes it easier to install the cap and also minimizes distortion of the hold ring 2 upon unscrewing of the cap.

Even after complete unscrewing of the cap body 1, it remains attached by flange 5 to the hold ring 2 which is retained at the neck 12 of the bottle 10. The neck 12 is freed from the cap body 1 by lifting and pivoting the cap body 1 toward the outside around the attachment flange 5, which serves as a hinge. In order to facilitate such pivoting, the attachment flange 5 has a thickness less than the thickness of the ring 2.

To then restopper the bottle neck 12, it is sufficient to pivot the cap body 1 over the neck and screw it back onto the latter. Due to its permanent deformation which occurred upon the first unscrewing, the hold ring 2 then occupies the position shown in FIG. 3, at which it is spaced from the cap body 1 over the major part of its periphery. This provides a clear indication that the bottle has already been opened.

The fact that the cap body 1 remains permanently attached to the hold ring 2, which in turn remains hooked to the bottle neck, has a number of advantages. The risk that the cap body 1 will pop off upon unscrewing ("champagne effect") is avoided in the event that the bottle, for instance, contains a carbonated beverage. Furthermore, the cap body cannot be lost.

Nevertheless, the cap with its tamper-proof hold ring can be withdrawn from the neck if desired by a simple pull exerted on the unscrewed cap body. This would be of interest for re-use of deposit bottles as well as for the recycling of non-deposit bottles. In fact, in both cases it is advantageous to be able to free the bottles from both the screw caps and the tamper-proof hold rings.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A screw cap for covering the opening in the neck of a container, comprising:

the cap being a single molded member comprised of a semi-rigid material, having the ability to flex elastically;

the cap comprising:

a cap body, including an end for covering the opening in the container neck and including a lower edge away from the end;

a closed, annular, hold ring for surrounding the container below the neck thereof; the ring being connected to the cap body at the lower edge of the cap body by a plurality of attachment tabs which are sized and shaped for being breakable upon being stressed more than a predetermined amount;

a plurality of lock-lugs attached to the ring and protruding inwardly from the ring and also toward the end of the cap body, and the lock-lugs terminating at respective free ends, which free ends are adapted for engaging an element of the container to prevent raising of the lock-lugs past that container element; the lock-lugs protruding in such a manner that a circle passing through the free ends of the lock-lugs has a diameter less than the diameter of the container element;

a flange for providing a generally non-breakable connection between the cap body and the ring, said flange being flexible for permitting the cap body to pivot off the hold ring with the flange serving as the pivot hinge, said flange being located between two tabs of said plurality of attachment tabs.

2. The screw cap of claim 1, wherein the ring has an inside diameter that is at least equal to the outside diameter of the cap body.

3. The screw cap of claim 1, wherein the ring supports six of the lock-lugs spaced around the ring.

4. The screw cap of claim 1, further comprising a respective weakening notch at both annular sides of the flange and extending into the ring from the edge of the ring that faces toward the cap body.

5. The screw cap of claim 4, wherein the flange has an annular width that is greater than that of the tabs and has a radial thickness that is less than that of the ring, whereby the flange may flex to serve as a hinge between the cap body and the ring.

6. In combination, the screw cap of claim 4, and a container having an open neck; the container element comprising a mating ring on the container generally at the neck, and the mating ring being positioned for being engaged and pressed against from beneath by the free ends of the lock-lugs as the cap is placed over the open neck.

7. The screw cap of claim 4 wherein each of the weakening notches extends into said ring for at least half the height of said ring.

8. The screw cap of claim 7, wherein the flange has an annular width that is greater than that of the tabs and has a radial thickness that is less than that of the ring, whereby the flange may flex to serve as a hinge between the cap body and the ring.

9. The screw cap of claim 8, wherein the flange is also located between two adjacent lock-lugs of said plurality of lock-lugs.

10. In combination, the screw cap of claim 9, and a container having an open neck; the container element comprising a mating ring on the container generally at the neck, and the mating ring being positioned for being engaged and pressed against from beneath by the free ends of the lock-lugs as the cap is placed over the open neck; said cap body including a screw threaded annular portion between the end of the cap body and the attachment tabs for enabling the cap body to be screwed onto the neck of the container.

11. The screw cap of claim 1, wherein the flange is also located between two adjacent lock-lugs around the ring.

12. In combination, the screw cap of claim 1, and a container having an open neck; the container element comprising a mating ring on the container generally at the neck, and the mating ring being positioned for being engaged and pressed against from beneath by the free ends of the lock-lugs as the cap is placed over the open neck.

13. The screw cap of claim 1, wherein the flange has an annular width that is greater than that of the tabs and has a radial thickness that is less than that of the ring, whereby the flange may flex to serve as the hinge between the cap body and the ring.

14. The screw cap of claim 1, wherein the cap body includes a screw threaded annular portion between the end of the cap body and the attachment tabs for enabling the cap body to be screwed onto the neck of the container.

15. In combination, the screw vap of claim 14, and a container having an open neck; the container element comprising a mating ring on the container generally at the neck, and the mating ring being positioned for being engaged and pressed against from beneath by the free ends of the lock-lugs as the cap is placed over the open neck; the container neck being matingly screw threaded for screw threadedly cooperating with the threaded annular portion of the cap body.

16. The screw cap of claim 1, wherein the cap is comprised of a semi-rigid plastic material.

17. The screw cap of claim 1, wherein the cap body and the ring are integral and are integrally joined by the attachment tabs.

18. In combination, the screw cap of claim 1, and a container having an open neck; the container element comprising a mating ring on the container generally at the neck, and the mating ring being positioned for being engaged and pressed against from beneath by the free ends of the lock-lugs as the cap is placed over the open neck.

* * * * *